United States Patent [19]

Tax

[11] 4,007,598

[45] Feb. 15, 1977

[54] ARTIFICIAL ISLAND AND METHOD OF ASSEMBLING THE SAME

[76] Inventor: Hans Tax, Potsdamer Str. 3, D-8 Munich 40, Germany

[22] Filed: Dec. 8, 1975

[21] Appl. No.: 638,338

[30] Foreign Application Priority Data

Dec. 16, 1974 Germany ..... 2459478

[52] U.S. Cl. ..... 61/90; 61/92; 61/96; 61/97

[51] Int. Cl.[2] ..... E02D 17/00

[58] Field of Search ..... 61/46.5, 48, 46, 90, 61/92, 96

[56] References Cited

UNITED STATES PATENTS

| | | | |
|---|---|---|---|
| 2,938,354 | 5/1960 | Knapp | 61/46.5 |
| 3,001,370 | 9/1961 | Templeton | 61/46.5 |
| 3,118,283 | 1/1964 | True et al. | 61/46.5 |
| 3,277,653 | 10/1966 | Foster | 61/46.5 |
| 3,844,127 | 10/1974 | Koop, Jr. et al. | 61/46.5 |

*Primary Examiner*—Jacob Shapiro
*Attorney, Agent, or Firm*—Hans Berman

[57] ABSTRACT

An artificial island including at least one modular, upright supporting column having a base portion normally standing on the ocean floor, a platform supported by the column or columns in an operative position above the water surface, one or more floats sufficiently buoyant when filled with air to hold the platform in its operative position, and guide cables guiding the floats between a position of engagement with the platform and a position adjacent the ocean floor is assembled by floating the platform, floats, and column modules on the water surface to a desired location, lowering the column into the water until its base portion engages the ocean floor, attaching the floats to the platform in fixed spatial relationship while the floats are at least partly flooded and submerged, raising the platform by expelling water from the floats by means of compressed air, fastening the raised platform to the column in the operative position, and releasing the floats. The column may be assembled at the selected site from the base portion and modular sections sequentially secured to the platform while the latter still floats on the water surface.

8 Claims, 9 Drawing Figures

ARTIFICIAL ISLAND AND METHOD OF ASSEMBLING THE SAME

This invention relates to artificial islands, and particularly to an improvement in the method of assembling an artificial island from its prefabricated components at a desired location, and to the island so obtained.

In one of its more specific aspects, the invention is concerned with the assembly of an island essentially consisting of a platform and of one or more supporting columns whose base portions stand on the ocean floor or on the floor of another body of water, the platform being supported by the column or columns in an operative position which is above the water surface at all times. It is known to float prefabricated platforms and columns from a construction site on dry land to a desired location, to lower a column in the water until its base portion engages the floor of the body of water, thereafter to raise a platform above the surface along the column, and to fasten the raised platform to the column in the desired operative position.

In all assembly methods of the type described which are in present practical use, the weight of the platform is transmitted to the column while the platform is gradually lifted from the water by means of devices which engage the platform and the column to move the platform upward along the column. Such lifting devices can cooperate only with columns of limited shape and structure, and are generally costly and complex.

It is a primary object of this invention to simplify the assembly operation described above, particularly the step of raising the platform, so as to avoid the need for specific configuration of the supporting column, and for lifting devices which transmit the weight of the platform to the column during the raising of the platform from the water surface to its operative position.

It is another object of this invention to provide an artificial island of the type described which may be transported from one site in a body of water to another site while almost fully assembled.

With these objects and others in view, as will hereinafter become apparent, according to the method of the invention, at least one, but preferably several hollow floats are placed in the water at a level below the platform while the platform is floating on the water surface at the desired location, and while the floats contain an amount of water sufficient to keep them substantially completely submersed. The submersed floats are attached to the platform, and enough water is expelled from the floats until the platform is raised to its operative position by the buoyancy of the floats. The raising step thus does not rely on the supporting column or columns, and the raised platform may be fastened to the column or columns in any desired manner. The floats thereafter may be released from the platform, flooded with liquid until they sink, and secured to the bottom portion of the supporting column.

The resulting island according to the invention has a column standing on the floor of a body of water, a platform fastened in weight transmitting relationship to the column above the surface of the water body, at least one float, means for alternatively filling the float with gas and liquid and for thereby making it lighter or heavier than the displaced water, means for attaching the float to the platform, and a guiding device for guiding the float in a vertically extending path between a first position of engagement with the platform and a second position in which the float is adjacent the floor of the body of water and downwardly remote from its first position.

Other features, additional objects, and many of the attendant advantages of this invention will readily be appreciated as the same becomes better understood by reference to the following detailed description of a preferred embodiment when considered in connection with the appended drawing in which:

FIGS. 1*a* and 1*b* jointly illustrate the components of an artificial island being floated by tugs to a desired location in side elevation;

Figure 1A:
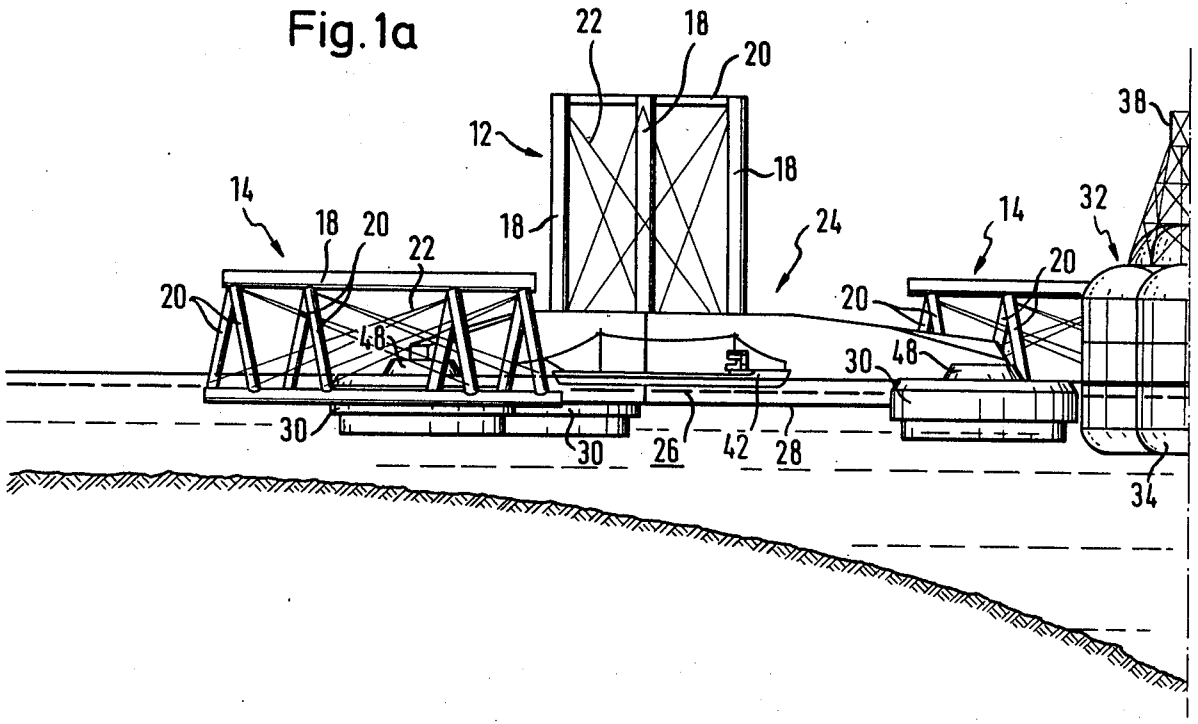
Figure 1B:
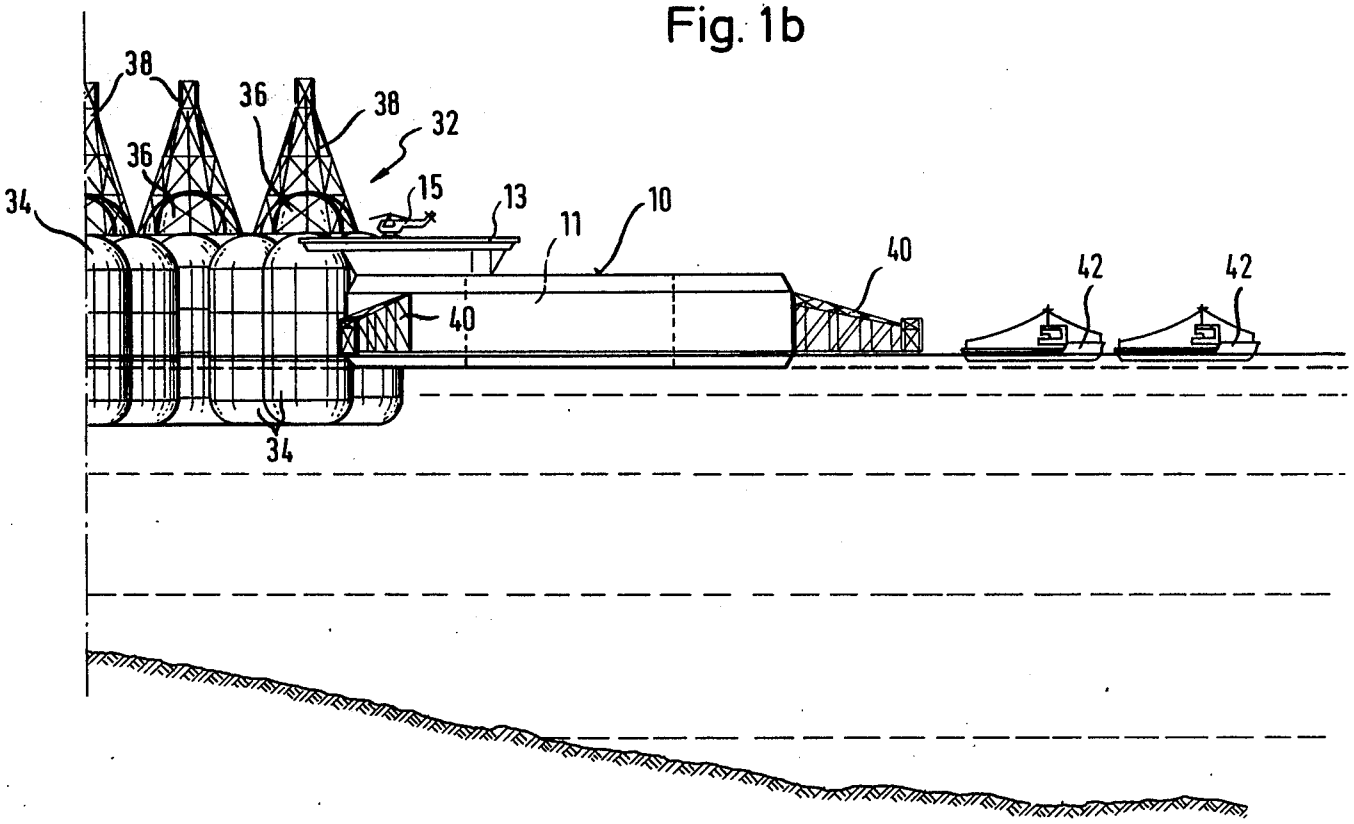

Referring now to the drawing in detail, and initially to FIGS. 1*a* and 1*b*, there are shown the floating components of the island to be assembled as they are being towed from a shipyard or other construction site on dry land to the intended location of the island. Two leading tugs 42 are followed by a hollow concrete platform 10 of approximately square shape and formed with a vertical aperture 11 extending through its center. Three rigid lattice girders 40 project horizontally from the platform and equiangularly relative to the vertical axis of the aperture 11. A landing pad 13 on the platform 10 carries a helicopter 15.

Lashed behind the floating platform 10 are three composite floats 32. Each float 32 consists of seven fixedly connected, substantially identical steel tanks having each the shape of an upright cylinder axially sealed by hemispherical dished end walls. Six tanks 34 are arranged on a common level about the central, seventh tank 36 which is upwardly offset from the tanks 34 so that the composite float 32 has a central projection on top and a corresponding central recess, not explicitly shown, in its bottom. A rigid tower 38 of lattice structure fixedly secured to the central projection of the float 32 extends vertically upward from the tank 36.

The floats 32 are followed by the stump or bottom portion 12 of a column to be erected at the intended location of the assembled island. As is better seen in FIG. 8, the stump 12 includes a base portion 24 whose back bone is a horizontal, equilateral triangle of rectangular steel tubes 26. Three arms 28 of the same, rectangular tubular material are longitudinally aligned with respective tubes 26 and project outward from the corners of the triangle. Their free ends carry pads 30 which are sealed steel tanks of stepped, circular cross section, the top of each pad 30 carrying a frustoconical dome 48 matching one of the afore-mentioned central recesses in a float 32. While floating to the island location, the base portion 24 is filled with air and buoyant.

Figure 8:
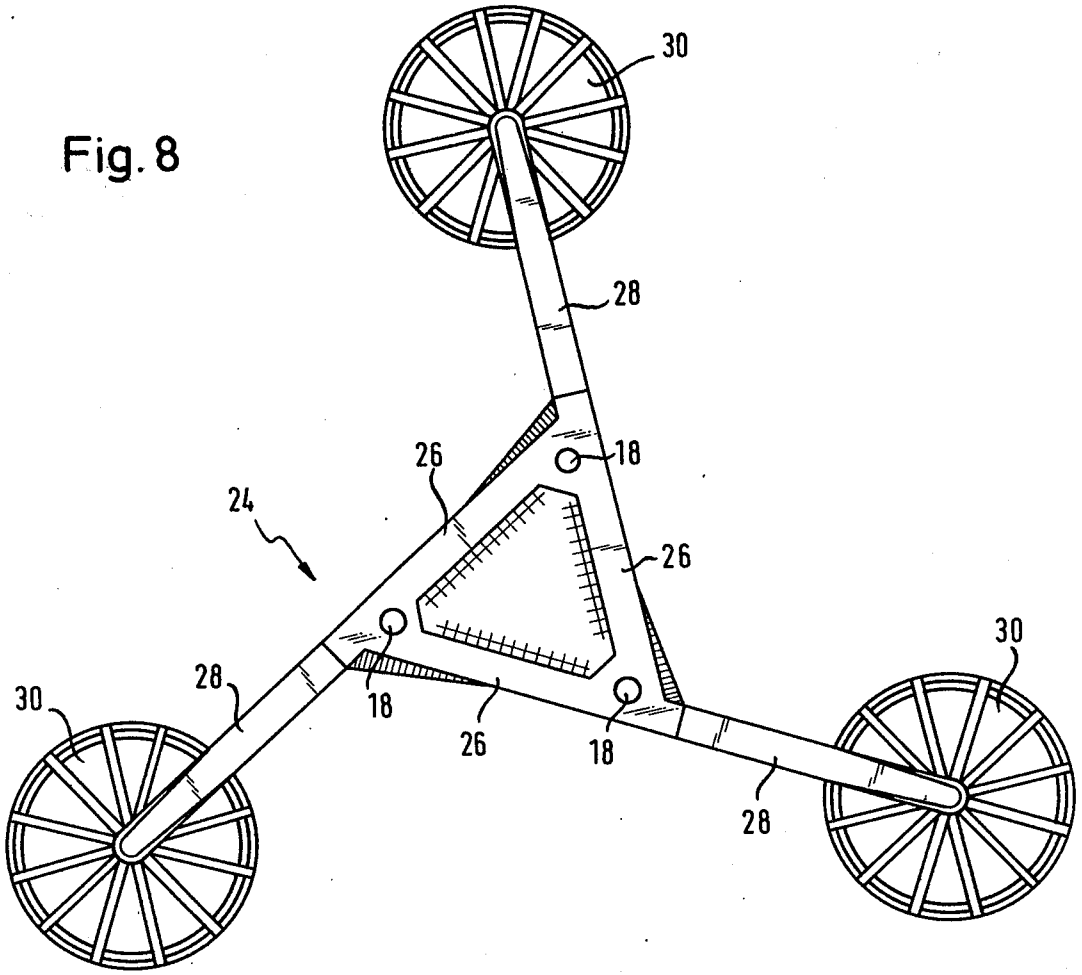
FIG. 8 is a top plan view of the bottom portion of a supporting column which is a component part of the same island.

The supporting column of the island to be assembled consists essentially of the base portion 24 and several modular sections 14 of which one is assembled with the base portion 24 to constitute the stump 12 during transportation to the assembly site, others being partly submersed but buoyant and secured laterally to the base portion 24. Each section 14 has three normally upright, tubular corner posts 18 connected by transverse, tubular braces 20 and by diagonal, tensioned wires 22. As is best seen in FIG. 8, the corner posts 18 of the lowermost section 14 rest on the three corners of the triangular backbone of the base portion 24. The posts 18 and braces 20 are sealed and air-filled so as to make the sections 14 buoyant.

Figure 2:
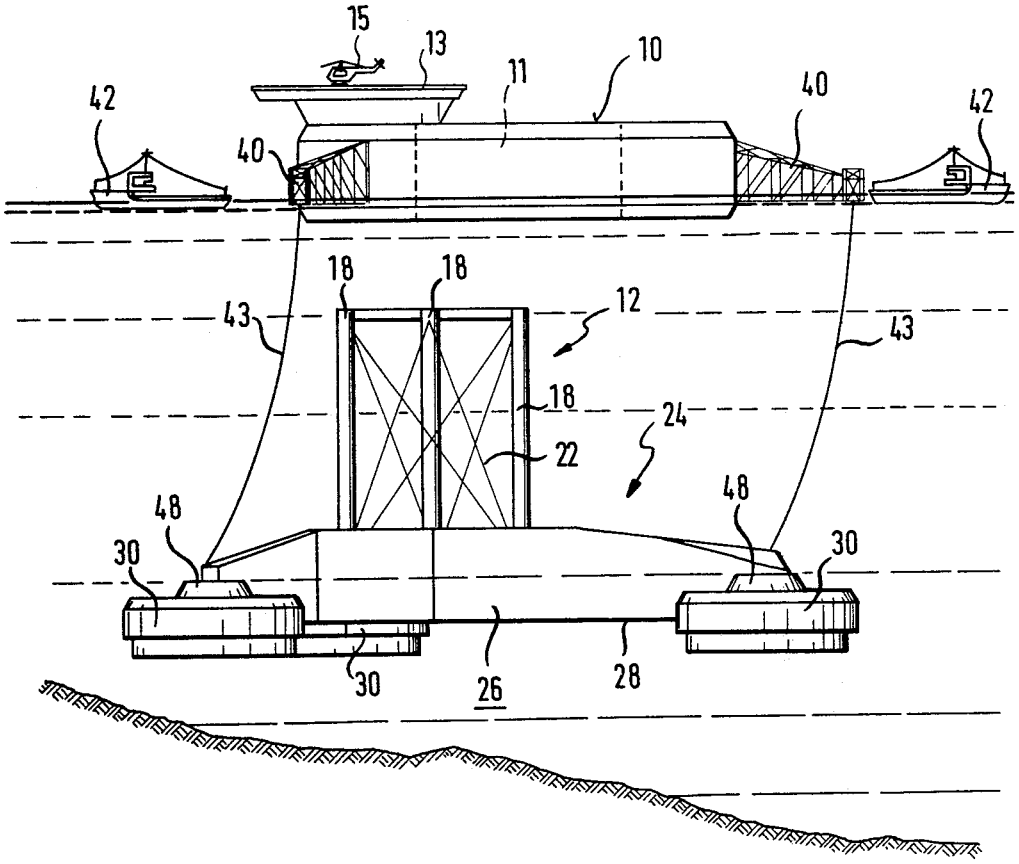
FIG. 2 shows components of the island aligned at the location for a first assembly step in an elevational view.
Figure 3:
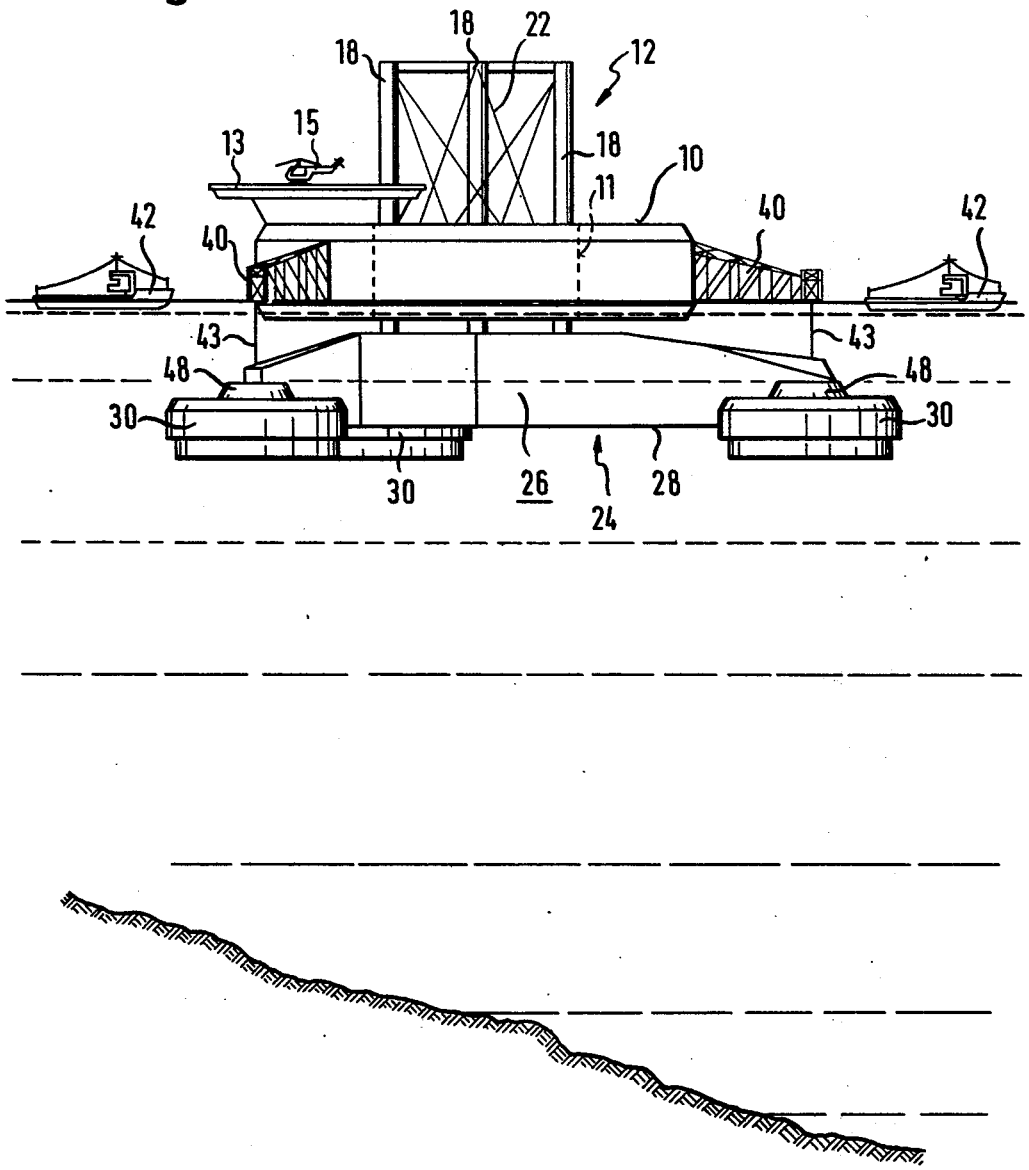
FIG. 3 shows the partly assembled components of the device of FIG. 2 in a corresponding view.

Upon arrival at the assembly site, the components shown in FIGS. 1*a* and 1*b* are released from each other and individually secured by anchors or tugs 42 in a manner only partly shown in FIG. 2. The ends of the three arms 28 are connected by hawsers 43 to winches on the three horizontal girders 40 on the floating platform 10, and seacocks on the base portion 24, non-illustrated but conventional, are opened until the base portion loses its buoyancy and, guided by the hawsers 43, drops below the platform 10, the upright position of the stump 12 being maintained by the buoyancy of the corner posts 18 and transverse braces 20, the latter being largely omitted from FIGS. 2 to 8 in order not to crowd the drawing.

Ultimately, the stump 12 is vertically aligned with the aperture 11 in the platform 10. The base portion 12 is then connected to a compressor on the platform 10 or on one of the tugs 42, and its flooded interior is again filled with air and sealed. The hawsers 43 are wound on the afore-mentioned winches, not shown, to guide the rising stump 12 into the position shown in FIG. 3 in which its corner posts 18 project upward into the air through the aperture 11, while the pads 30 are aligned with the free ends of the girders 40.

Figure 4:
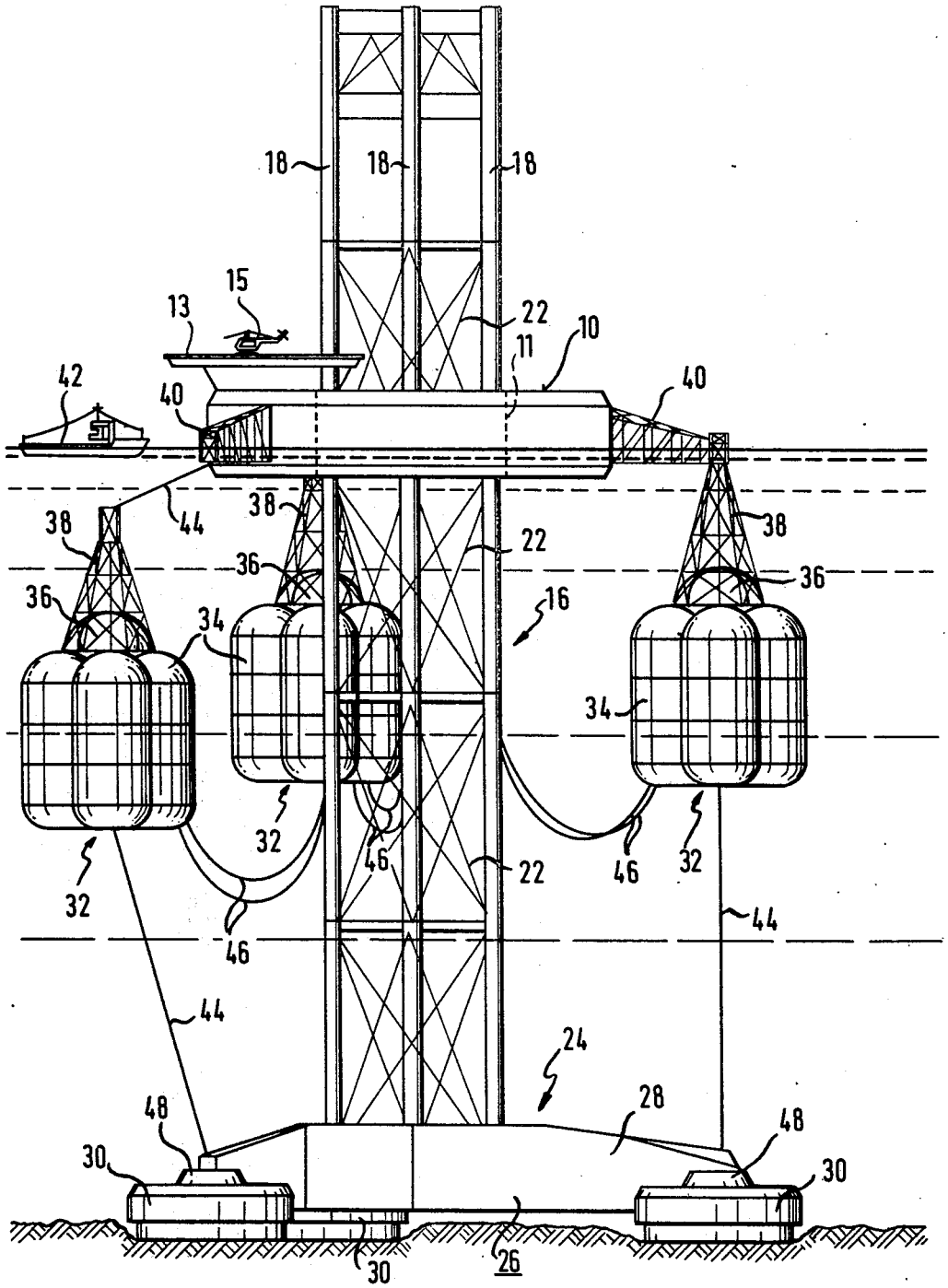
FIG. 4 illustrates the island approaching the assembled state in elevational view.
Figure 5:
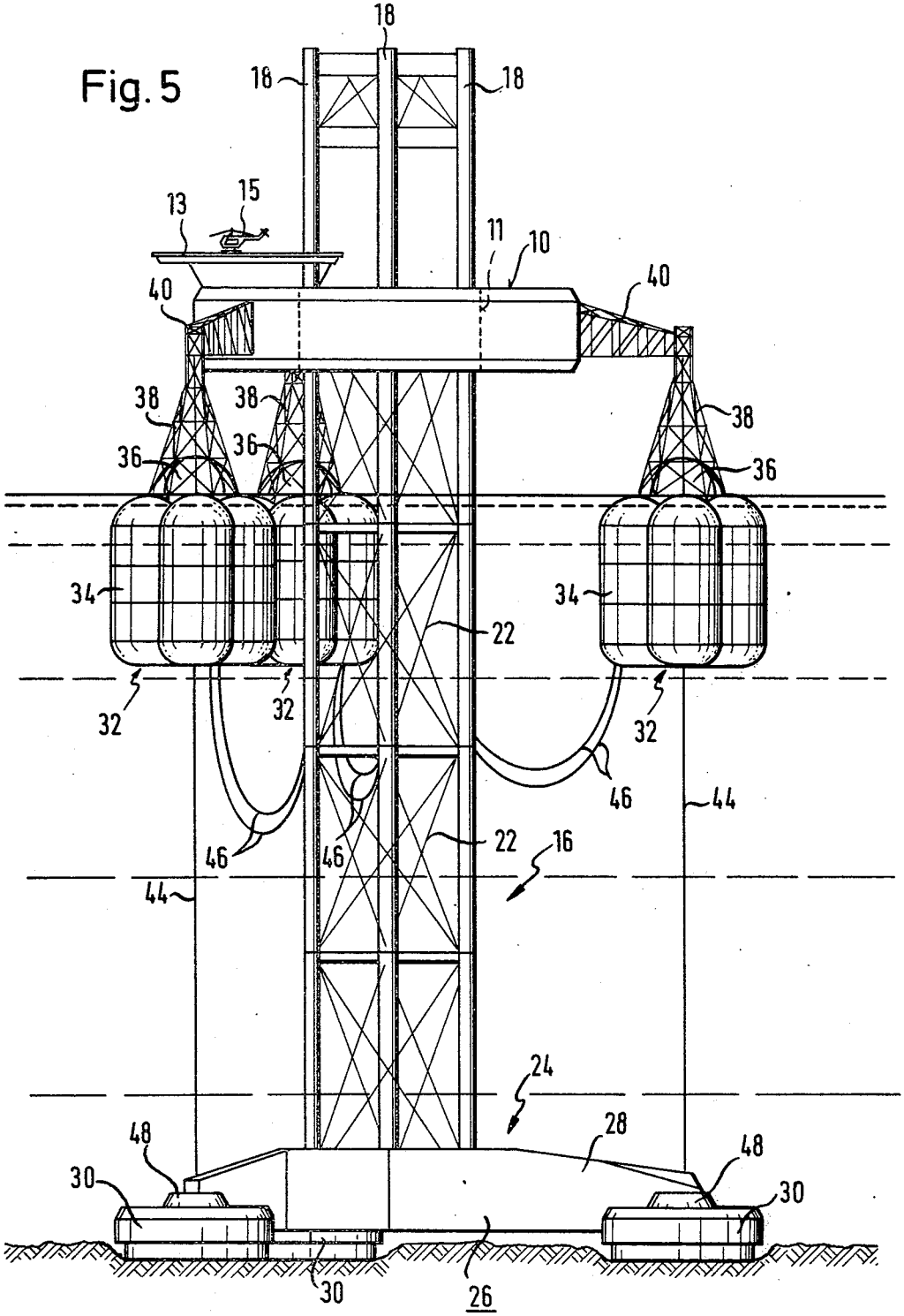
FIG. 5 shows the island of FIG. 4 with its platform raised to the operative position by floats.
Figure 6:
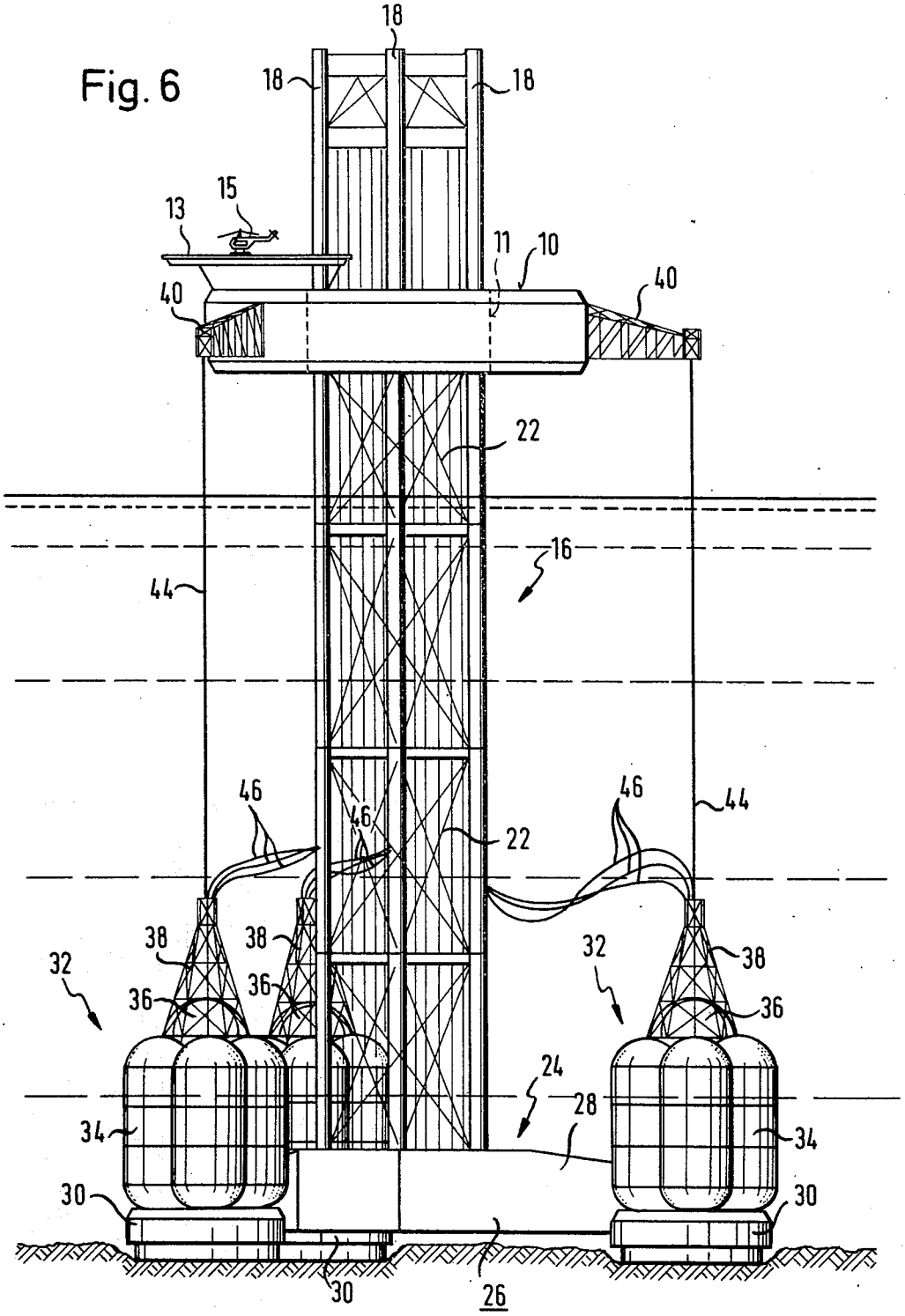
FIG. 6 is an elevational view of the completed island with the floats submersed for later use.

Additional floating modules 14 are lifted sequentially from the water surface by the helicopter 15 and set on the stump 12 in proper alignment of the corner posts 18 which are fixedly, but releasably fastened to each other in a conventional manner. The base portion 24 is gradually flooded with water as more modules 14 are assembled to keep the newly formed junction in the resulting column 16 within reach of workers operating from non-illustrated scaffolding on the platform 10. Assembly of the column 16 is complete when the pads 30 are set on suitably prepared portions of the ocean floor, as is shown in FIG. 4, the hawsers 43 being paid out as needed and removed when the column 16 is firmly seated on the ocean floor, the pads 30 being vertically aligned with the girders 40.

Each composite float 32 is secured by a guide cable 44 to a winch (not shown) on a girder 40 and the aligned pad 30 and partly flooded with water until it loses its buoyancy and can be positioned upright below the associated girder 40 by pulling in the cable 44. Hoses 46 attached to a water pump and an air compressor (not shown) on the platform 10 are connected to each composite float 32. Water in the float is replaced by air while the tower 38 is guided to the free end of the associated girder 40 and fixedly connected to the girder. When all three floats 32 are attached to the girders 40, they are further pumped out in unison to raise the platform 10 to its operative position above the water surface shown in FIG. 5.

During the lifting of the platform 10, the column 16 moves freely relative to the platform in the aperture 11, and the lifted platform 10 is releasably attached to the column 16 in a conventional manner after reaching its operative position. The weight of the platform 10 being safely transmitted to the column 16, the towers 38 may be released from the girders 40, and the tanks 34, 36 may again be flooded through the hoses 46 with water or fuel needed for operation of equipment on the platform 10. If the platform 10 carries equipment for drilling an oil well, the tanks 34, 36 may be used for temporary storage of the crude oil while they rest on respective pads 30, a dome 48 of each pad being received conformingly in the bottom recess of the associated float 32 to assist the guide cable 44 in maintaining the position of the float.

Figure 7:
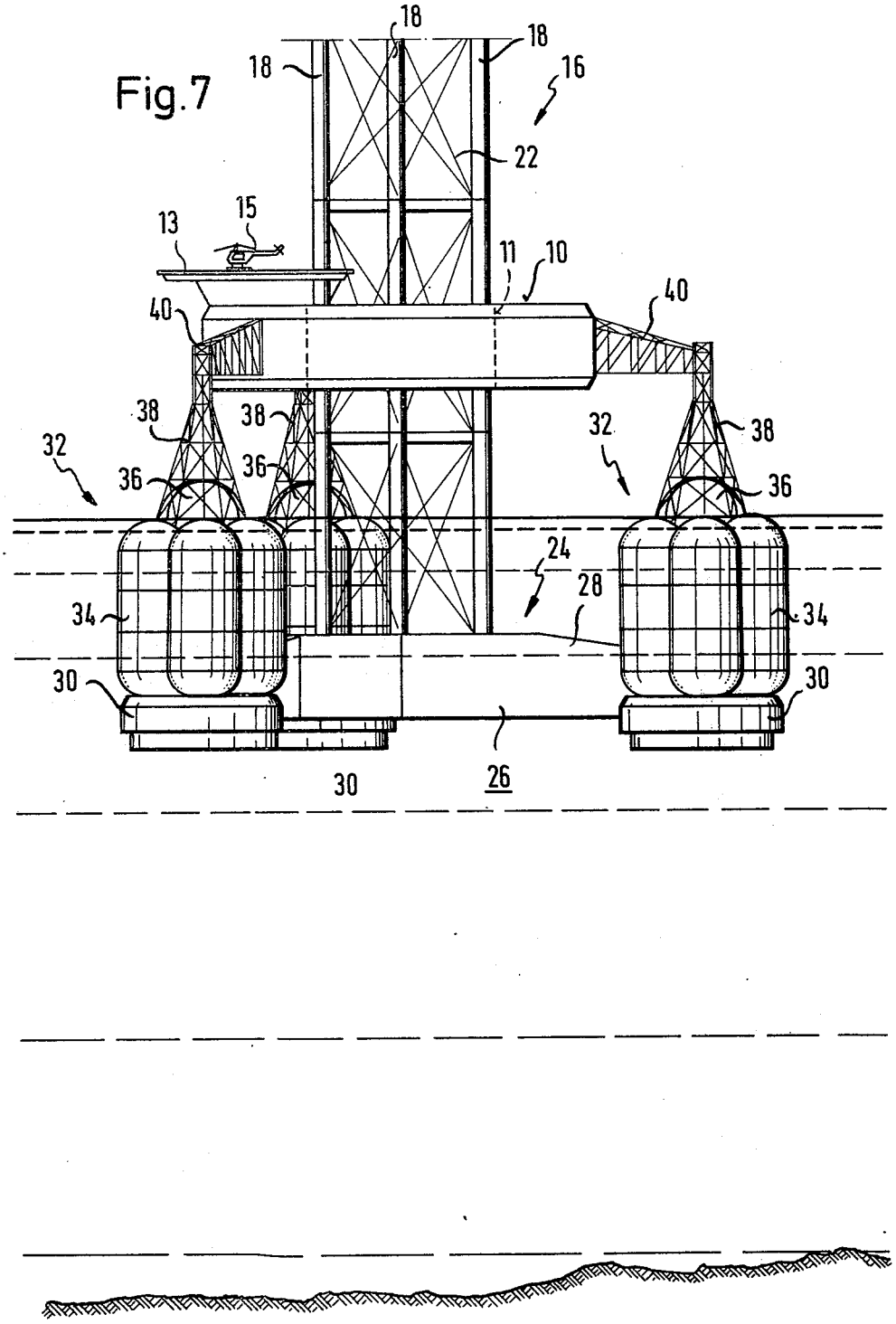
FIG. 7 shows most of the elements of the island of FIG. 6 supported on the floats for transfer to a different location while still partly assembled.

If the components of the island are to be transferred to a remote site, they are released from each other by a reversed sequence of operations obvious from the described assembly procedure, and towed in the manner shown in FIGS. 1*a*, 1*b*. For shifting the island over a short distance, complete disassembly of the components is unnecessary. Air is pumped into the floats 32 through hoses 46 until the towers 38 reach the girders 40 and may be attached to the platform 10 to hold the platform near its operative position above the water surface when subsequently released from the column 16. The latter may then be raised by pumping air into the base portion 24 and retracting the guide cables 44 until the domes 48 of the pads 30 are again received in the bottom recesses of the floats 32, and the condition illustrated in FIG. 7 is reached. Modules 14 may have to be removed from the top of the column 16 for a buoyancy of the column adequate to hold the pads 30 in engagement with the floats 32, and also for lowering the center of gravity of the apparatus for subsequent movement by tugs to the new site where the island is quickly established by lowering the column 16 and attaching the platform 10 to the lowered column. The floats 32 may again be guided to their bottom position by the cables 44.

Depending on the distance to be traveled by the island, it may be sufficient to raise the column 16 merely sufficiently to clear obstacles on the ocean floor without engaging the floats 32 by the pads 30, but the arrangement illustrated in FIG. 7 is generally safer.

Reinforced concrete is the preferred material for construction of a platform 10 having an effective top surface of approximately 100 m × 100 m and a height of about 20 m. Steel may be substituted for the concrete walls of the hollow platform 10 if the platform is smaller. Conversely, the column 16 assembled from steel tubing and steel wires may be replaced by a different column of other material of construction, and its shape and size may be selected freely to suit the application since it need not accommodate lifting apparatus for the platform 10.

A single column is sufficient under many conditions to support a platform of the invention, and the use of several floats attached to the platform in weight transmitting relationship while equiangularly spaced about the longitudinal column axis during the lifting of the platform is preferred when assembling an island having a single column. More than one column may be used and need not pass through a central opening in the platform. In such an arrangement, a single float may be connected to the available central platform portion and may be of a structure different from that specifically illustrated and preferred in the illustrated embodiment of the invention.

It should be understood, therefore, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. In a method of assembling, in a body of water, an artificial island consisting essentially of a platform and of at least one upright supporting column including a bottom portion standing on the floor of said body of water and a plurality of sections extending upward from said bottom portion in superimposed relationship, said platform being supported by said at least one column in an operative position above the surface of said body of water, in which method said column and said platform are floated on the surface of said body to a desired location, the column is lowered in said water until said bottom portion engages said floor, the platform thereafter is raised above said surface along said column, and the raised platform is fastened to said column in said operative position, the improvement which comprises:

a. attaching a first one of said sections to said bottom portion to constitute a sub-assembly therewith, said bottom portion being hollow;

b. filling said bottom portion with enough air to make said sub-assembly buoyant;

c. floating said buoyant sub-assembly and said platform to an assembly site;

d. flooding said hollow bottom portion at said assembly site with sufficient water to submerge said sub-assembly below said surface, said platform being formed with an aperture extending vertically therethrough;

e. aligning the submerged sub-assembly with said aperture;

f. expelling enough water from said bottom portion to make said sub-assembly buoyant until a part of said sub-assembly enters said aperture; and g. securing the sub-assembly partly entered in said aperture to said platform while the platform floats at said site.

2. In a method as set forth in claim 1, lowering said secured sub-assembly toward said floor, attaching a second section to said first section to enlarge the lowered sub-assembly; repeating the attaching of a section to a section previously attached to said bottom portion and said lowering until said bottom portion engages said floor.

3. In a method as set forth in claim 2, placing at least one hollow float in said water at a level below said platform while said platform is floating on said surface at said site and said float contains an amount of water sufficient to keep the float substantially completely submersed, connecting said at least one float to said platform, and expelling said amount of water from said float until said platform is raised to said operative position by the buoyancy of said at least one float.

4. In a method as set forth in claim 3, a plurality of said floats being placed at said level and circumferentially distributed relative to said platform, each float being secured to said platform in a fixed spatial relationship prior to said expelling of water from each of said floats.

5. In a method as set forth in claim 4, said floats being floated to said location while disconnected from said platform.

6. In a method as set forth in claim 4, said floats, after said fastening of said platform in said operative position, being released from said platform, flooded until they sink to said floor, the sunken floats being secured to said bottom portion.

7. In a method as set forth in claim 6, said floats when secured to said platform in said fixed spatial relationship being vertically aligned with respective parts of said bottom portion.

8. In a method as set forth in claim 6, releasing said floats from said bottom portion, filling the released floats with air until they become buoyant and engage said platform with a force sufficient to support the weight of the engaged platform substantially in said operative position, thereafter raising said column until said bottom portion is lifted from said floor, thereafter moving said platform, said column, and said floats to another location, and lowering said column at said other location until said bottom portion engages said floor.

* * * * *